US006705914B2

(12) United States Patent
Tsutatani et al.

(10) Patent No.: US 6,705,914 B2
(45) Date of Patent: Mar. 16, 2004

(54) METHOD OF FORMING SPHERICAL ELECTRODE SURFACE FOR HIGH INTENSITY DISCHARGE LAMP

(75) Inventors: Takashi Tsutatani, Takatsuki (JP); Yoshiki Kitahara, Takatsuki (JP); Toshiyuki Shimizu, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 268 days.

(21) Appl. No.: 09/836,726

(22) Filed: Apr. 17, 2001

(65) Prior Publication Data

US 2001/0030498 A1 Oct. 18, 2001

(30) Foreign Application Priority Data

Apr. 18, 2000 (JP) ..... 2000-116699
Jun. 23, 2000 (JP) ..... 2000-188785

(51) Int. Cl.[7] ..... H01J 17/04; H01J 61/04; H01J 9/04

(52) U.S. Cl. ..... 445/50; 445/6; 445/26; 219/121.66

(58) Field of Search ..... 445/6, 26, 46, 445/50; 219/121.66

(56) References Cited

U.S. PATENT DOCUMENTS 3,067,357 A 12/1962 Fridrich
5,178,742 A * 1/1993 Lemke et al. ..... 205/664
5,357,167 A 10/1994 Mathews et al.
5,484,315 A * 1/1996 Juengst et al. ..... 445/26
6,465,758 B1 * 10/2002 Ham ..... 219/121.66

FOREIGN PATENT DOCUMENTS

| | | |
|---|---|---|
| DE | 19652822 | 6/1998 |
| EP | 584859 | 3/1994 |
| JP | 4430956 | 12/1969 |
| JP | 5283039 | 10/1993 |
| JP | 9-107168 | 4/1997 |
| JP | 9165641 | 6/1997 |
| JP | 1092377 | 4/1998 |
| JP | 10092377 | 4/1998 |
| JP | 10-137960 | 5/1998 |
| JP | 2820864 | 8/1998 |
| JP | 11-080939 | 3/1999 |
| JP | 11 96964 | 4/1999 |
| JP | 11 97166 | 4/1999 |
| JP | 11-123577 | 5/1999 |
| JP | 2000-231902 | 8/2000 |
| JP | 2001 243911 | 9/2001 |

* cited by examiner

*Primary Examiner*—Kenneth J. Ramsey

(57) ABSTRACT

A high pressure discharge lamp which achieves a long life of at least 3000 hours and in which variations in lamp characteristics are suppressed is disclosed. In the high pressure discharge lamp of the present invention, during manufacturing of an electrode, a covering member 123 having a coil shape and being made of refractory metal is applied on a discharge side end of an electrode rod 122 made of refractory metal so as to cover a circumference of the electrode rod 122 in a vicinity of the discharge side end. The discharge side end 124 on which the covering member 123 is applied is fused into a semi-sphere by intermittently heat fusing the discharge side end according, for instance, to arc discharge or laser irradiation.

16 Claims, 17 Drawing Sheets

METHOD OF FORMING SPHERICAL ELECTRODE SURFACE FOR HIGH INTENSITY DISCHARGE LAMP

This application is based on Japanese Patent Application No. 2000-116699, No. 2000-188785, and No. 2001-94226 with domestic priority claimed from the former two applications, the content of which are hereby incorporated by reference.

BACKGROUND OF THE INVENTION (1) Field of the Invention

The present invention relates to an electrode for a high pressure discharge lamp, a high pressure discharge lamp, and a method of manufacturing therefor.

(2) Description of Related Art

In recent years there has been active development of projection type image display apparatuses such as liquid crystal projectors. In such a projection type image display apparatus it is necessary to have a high intensity light source close to a point light source. Generally a high pressure discharge lamp such as a high pressure mercury lamp or a metal halide lamp of the short arc type is used as this kind of light source.

One of the main technical tasks when developing high pressure discharge lamps of the short arc type is lengthening the life by improving the life characteristics. Namely, generally in high pressure discharge lamps of the short arc type, the tungsten which forms the electrode melts and disperses, the electrode tip becomes deformed and wears due to the temperature of the electrode end increasing excessively, while the dispersed tungsten is deposited on the inner surface of the light-emitting tube, causing blackening. This blackening of the inner surface of the light-emitting tube causes premature degradation of light flux. In order to solve this problem, conventionally various techniques have been investigated relating to design of electrodes for high pressure discharge lamps of the short arc type and manufacturing methods of the electrodes.

As prior art relating to the above described electrode design, an electrode which has a construction such as that shown in FIG. 1 has been developed. The electrode 901 shown in FIG. 1 is formed by an electrode rod 902 with a narrow shaft diameter, and a cylindrical electrode part 903 whose inside diameter is larger than the electrode rod 902, in combination. The characteristics of the operation of the electrode are (1) the cylindrical electrode part 903 lowers the temperature of the electrode tip 904 by transferring heat generated therein rapidly to the electrode rod side, suppressing deformation and wear of the electrode tip 904 by melting and dispersion of the electrode metal, and (2) through the working of the electrode rod 902 with a narrow shaft diameter, the whole of the electrode 901 is thermally insulated, promoting the evaporation of light emitting material enclosed in the light-emitting tube.

An electrode such as the electrode 901 is ordinarily manufactured by a grinding process of a block of a high melting point metal material such as tungsten, and is used as an anode in particular in high pressure discharge lamps of the short arc type such as super high pressure mercury lamps and high pressure xenon lamps of the DC discharge type which are subject to high rises in temperature.

Meanwhile, initially electrodes of the same construction as high pressure discharge lamps used for general lighting of the long arc type were used for metal halide lamps and high pressure mercury lamps of the short arc type which are used as light sources for projection type image display apparatuses of recent years. As shown in FIG. 2, an electrode 911 is formed by an electrode rod 912 made from ordinary tungsten, and a coil 913 of tungsten wire which has a narrow wire diameter. However, in a high pressure discharge lamp of the short arc type which uses an electrode such as the electrode 911, the above-described deformation and wear of the electrode tip due to melting and dispersion of the tungsten electrode material cannot be avoided, making lengthening the life of the lamp difficult.

Subsequently, as a way of solving the problem of lengthening the life of such a lamp, electrodes which have the basic structure shown in FIG. 1 which were developed for use in conventional high pressure discharge lamps of the short arc type were re-investigated. However, as it is costly to manufacture electrodes by a grinding process, an electrode that can be manufactured cheaply while having the same basic construction as the electrode 901 in FIG. 1 was investigated. Prior art relating to such electrodes is disclosed, for example, in Japanese Patent Number 2820864 and Japanese Patent Laid-Open No. H10-92377.

Examples of the electrodes of the above-described patents are shown in FIG. 3A and FIG. 3B. An electrode 921 is manufactured through two processes which are simple compared to the above-described grinding process: (a) first, a tungsten wire coil 923 is wound and set around the discharge end of the tungsten electrode rod 922 (see FIG. 3A), and (b) the discharge side end of the electrode rod 922 and the discharge side end of the coil 923 are melted and fused by a so-called electric discharging method to form an electrode tip 924 which is substantially a semi-sphere (see FIG. 3B).

In the electrode 921 the section formed by the coil 923 and the semi-spherical electrode tip 924 has the same effect as the cylindrical electrode part 903 and the electrode tip 904 of the electrode 901 shown in FIG. 1. Consequently, the heat in the semi-spherical electrode tip 924 is transferred rapidly to the coil 923, lowering the temperature of the electrode tip 924. In this way, even electrodes manufactured using low cost manufacturing electric discharging methods, melting and dispersion of the electrode material and deformation and wear of the electrode tip can be suppressed and life can be lengthened.

Please note that another piece of prior art relating to improving life expectancy of high pressure discharge lamps is a means which uses tungsten of high purity as an electrode material, disclosed in Japanese Patent Laid-Open No. H9-165641. Here, a result is shown that using tungsten of high purity in which the sum total of the elements of the accessory constituents Al, Ca, Cr, Cu, Fe, Mg, Mn, Ni, Si, Sn, Na, K, Mo, U and Th is regulated to 10 ppm of the principal component tungsten W is used as the electrode (particularly the anode) material in large discharge lamps with high output is effective in improving lamp electrode life span.

Based on the above-described related art, the present inventors worked toward developing a high pressure mercury lamp of the short arc type which can be used as a light source in projection type image display apparatuses. In the development the inventors set two objectives which relate in particular to the performance of lamps demanded by the market. The objectives were (1) making the distance between the electrodes, in other words, the distance between the discharge ends of the two electrodes provided in opposition in the light-emitting tube, no more than 1.5 mm, which is shorter than conventional spacing, in order to improve light usage efficiency when combined with a reflective mirror, and (2) to accomplish a lamp life expectancy of at least 3000 hours. Please note that (2) lamp life expectancy, as will be explained below, is defined by the aging time when the light flux maintaining rate estimated from the average illuminance maintaining rate of nine points on a screen during light emission by the lamp unit drops to 50%.

The present inventors, when beginning development, investigated developing a high pressure discharge lamp of the short arc type which has shorter distance between electrodes than conventional lamps, using electrodes made by an electric discharging method based on the methods in the above-described patents (FIGS. 3A and 3B). However, when the inventors measured characteristics of mass produced lamps which use such electrodes, they discovered much variation between lamps in characteristics such as voltage and life, meaning such lamps lack commercial viability.

Subsequently, when the cause of the above-described variations in lamp characteristics was investigated, it was revealed that the fused shapes of the electrode ends manufactured with the conventional electrical discharging method were not uniform semi-spheres, but rather various shapes and dimensions had been produced, and these various shapes and dimensions where the cause of the variation in lamp characteristics. For example, when the shape of the electrode tip was not semi-spherical, there were cases in which the discharge arc deviated from the center axis between the two electrodes. As a result the length of the discharge arc was longer than the design value, therefore the lamp voltage increased beyond the rating value range.

In particular, when the distance between electrodes is in the range of the inventors' objective of 1.5 mm or less, it was clear that fluctuations in lamp voltage according to this kind of variation in the length of the in discharge arc increase. Furthermore, when there are variations in the fused shape and the dimensions of electrode tips between lamps, the temperature of the electrode tips during discharge differs, giving rise to variations in the life of the lamps.

SUMMARY OF THE INVENTION

The object of the present invention is to provide a high pressure discharge lamp, a high pressure discharge lamp electrode and a manufacturing method therefor which achieves desirably a life of at least 3000 hours, and can suppress variations in lamp characteristics in a high pressure discharge lamp which uses an electrode of which the discharge side tip has been fused.

The above-described objective can be achieved by a method of manufacturing for a high pressure discharge lamp which includes a covering member applying step for applying a covering member made of refractory metal on a discharge side end of an electrode rod made of refractory metal so as to cover a circumference of the electrode rod in a vicinity of the discharge side end, and a fusing step for integrating the discharge side end into a semi-sphere by intermittently heat fusing the discharge side end on which the covering member is applied.

In this method of manufacturing, temperature of the electrode tip can easily be controlled in the electrode manufacturing process due to the discharge side tip of the electrode being heat fused intermittently. According to this method, variations in, for instance, shape of the electrode tip can be suppressed, more specifically, it is possible to form the electrode tip into a semi-sphere without causing internal holes for instance. Therefore, lengthening of the life of the lamp is achieved together with variations in lamp characteristics being suppressed.

Please note that by performing heat fusing intermittently the size of the average grain diameter in the crystallization of the electrode tip can be increased. Thus, for example, the above-described objective can be achieved by a high pressure discharge lamp including electrodes which are made of a material having tungsten as a main constituent and are placed in a light-emitting tube so that semi-sphere ends are in opposition, and an average grain diameter in tungsten crystallization of the electrode end being at least 100 $\mu$m. Deformities in the electrode can be suppressed due to the heat capacity increasing in the electrode tip of this kind of electrode whose average grain diameter in crystallization is large, contributing to lengthening the life of the high pressure discharge lamp.

Please note that as a specific method for the above-described intermittent heat fusing, the present inventors found that, for example, a method using discharge arc fusing or a method using a laser is particularly desirable.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF PREFERRED EMBODIMENTS

The preferred embodiments of the present invention will be explained with reference to the drawings.

First Embodiment

Figure 3B:
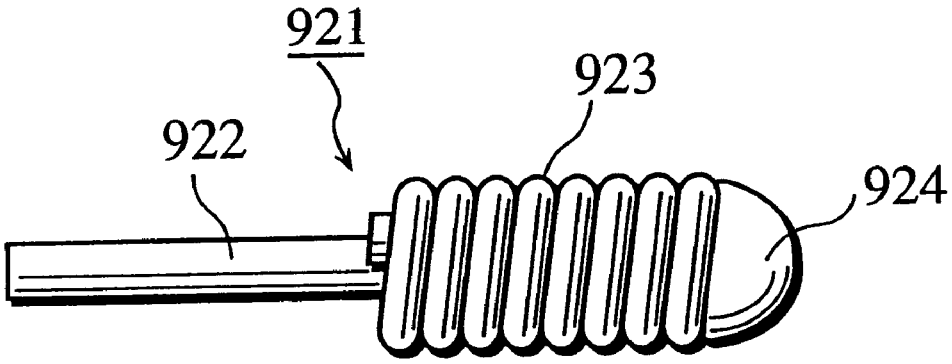
Figure 4:
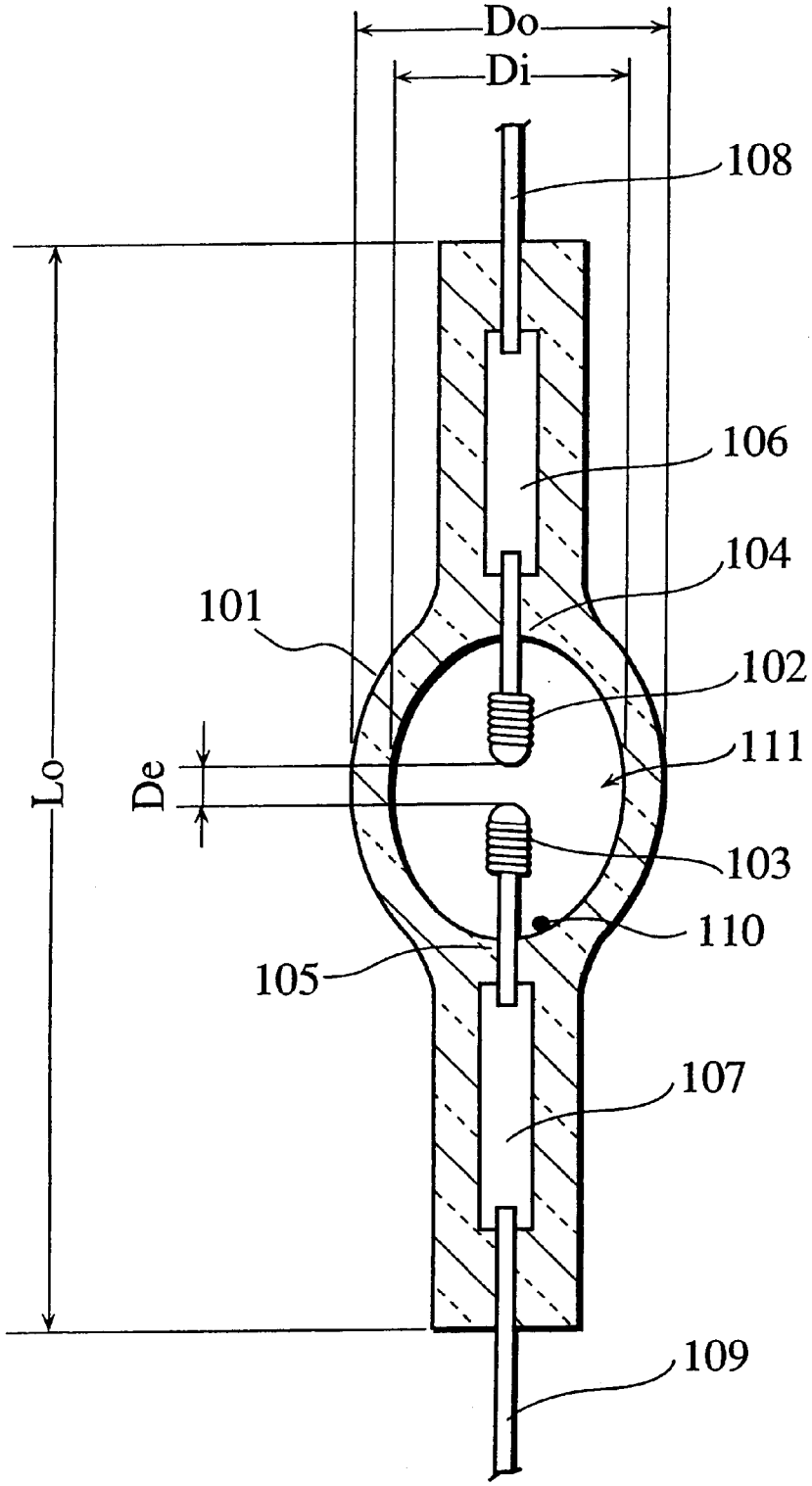
FIG. 4 shows the structure of the high pressure mercury lamp of an embodiment of the present invention.

FIG. 4 shows the construction of a high pressure mercury lamp of the present embodiment of the present invention. As shown in FIG. 4, the high pressure mercury lamp of the present embodiment is provided with a light-emitting tube 101 with a discharge space 111 therein, two electrodes 102 and 103 placed so as to be in opposition with a predetermined distance (De) between the two electrodes, each electrode extending respectively from sealers 104 and 105 which are at either end of the discharge space 111. The electrodes 102 and 103 have the same basic structure as the electrode 921 shown in FIG. 3B, but the electrodes are manufactured according to the manufacturing method of the present invention, which will be explained later.

An enveloping vessel of the light-emitting tube 101 is formed from quartz and has a substantially spheroid shape. The opposing tungsten electrodes 102 and 103 are respectively hermetically sealed in the sealers 104 and 105 through molybdenum foils 106 and 107 respectively. The molybdenum foils 106 and 107 are further connected respectively to external molybdenum lead wires 108 and 109. The light-emitting tube 101 has, according to the output of the lamp, a length 30 to 100 mm, a maximum outer diameter (Do) 5 to 20 mm, and a maximum inner diameter Di of the light-emitting tube 111 2 to 14 mm.

Here, the distance between the tungsten electrodes 102 and 103 (De) is conventionally set within a range of approximately 1.5 mm to 2.5 mm. However in the high pressure discharge lamp of the present embodiment, in order to make the lamp light usage rate higher and improve brightness on the screen, the value of the distance (De) is no greater than 1.5 mm, preferably regulated in a range of 0.5 to 1.5 mm. Indeed, the electrode manufacturing method of the present invention is not limited to electrodes used in high pressure discharge lamps with a distance of 1.5 mm or less between electrodes, but can be applied to electrodes of conventional high pressure discharge lamps.

A light emitting material mercury 110, and rare gases such as argon, krypton, and xenon for starter assistance, together with halogens such as iodine and bromine are sealed internally in the light emitting space 111. The amount of mercury 110 sealed is preferably regulated to a range of at least 150 $mg/cm^3$ of the volume of the light-emitting tube 111 (equivalent to approximately 150 bar or more of mercury vapor pressure during illumination of the lamp). It is desirable to set the sealed pressure of the rare gases when cooled in a range of 0.1 to 10 bar.

Figure 5:
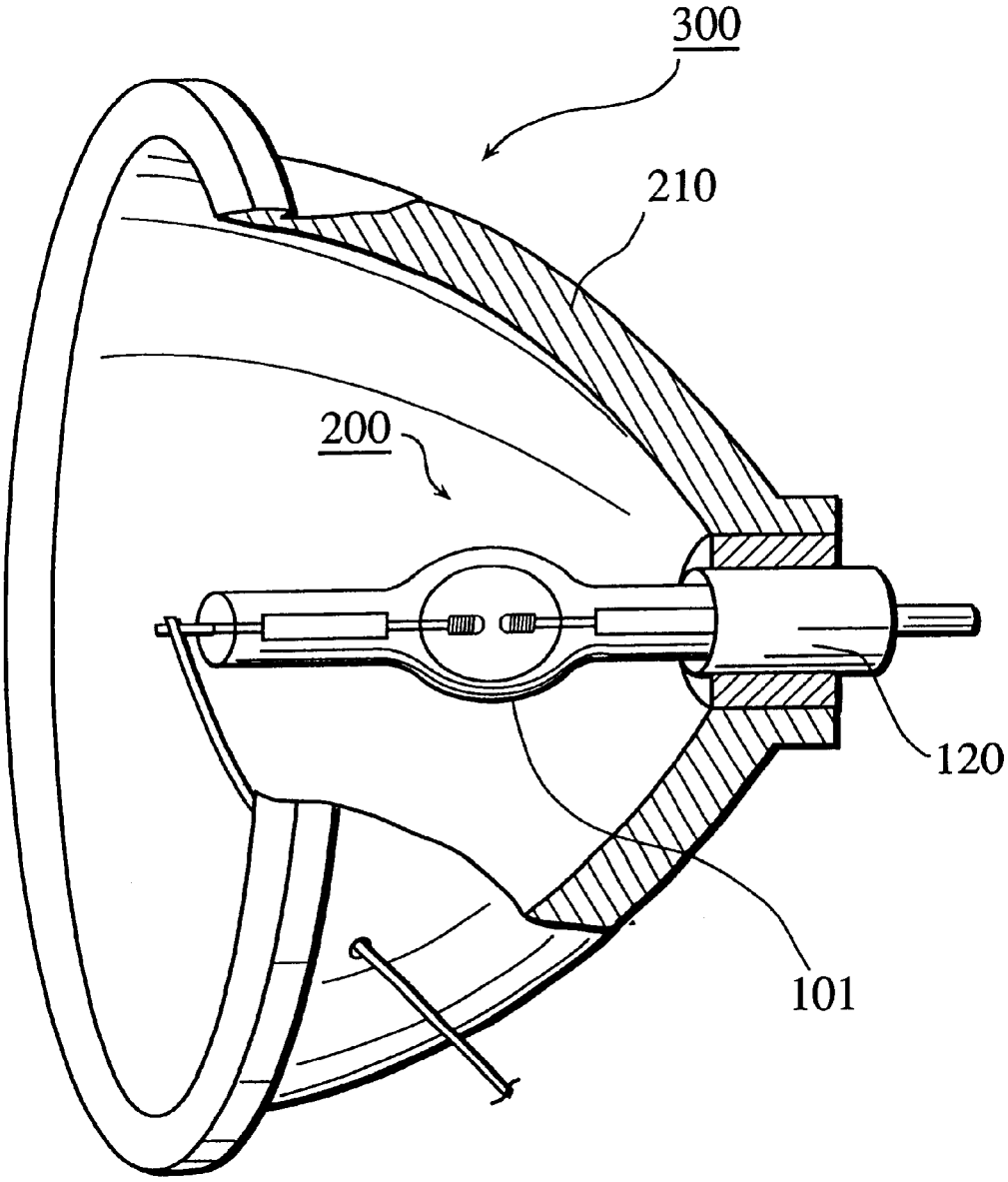
FIG. 5 is a partially cut away view showing the structure of the lamp unit 300.

Please note that when, for example, bromine is used as the halogen substance, it is desirable to set the range at $10^{-9}$ to $10^{-5}$ $mol/cm^3$. This is sealed to function so as to suppress blackening of the light-emitting tube by returning tungsten that has dispersed from electrodes and been deposited of the inner surface of the light-emitting tube 101 to the electrodes. Meanwhile, as shown in FIG. 5, a completed lamp 200 is constructed with a base 120 fitted at one end of the light-emitting tube 101, and the completed lamp 200 is further fitted with a reflecting mirror 210, forming a lamp unit 300.

Figure 6A:
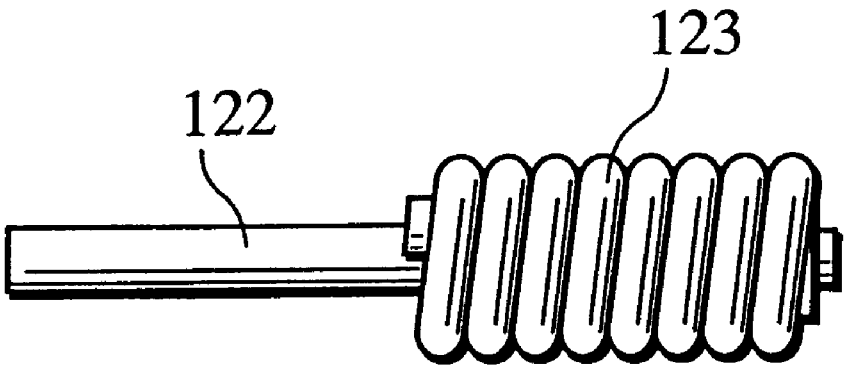
FIG. 6 is a drawing for explaining the manufacturing process of an electrode of the present invention.
Figure 6B:
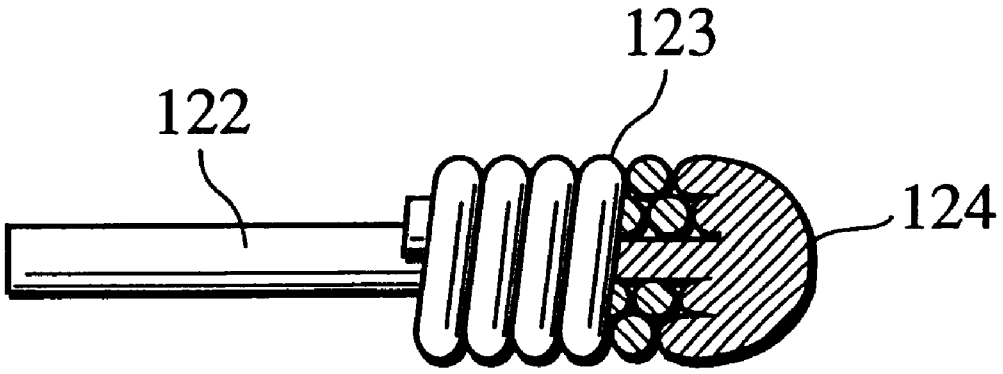

Meanwhile, the electrode 102 (the electrode 103 also), as shown in FIG. 6A and FIG. 6B is made through a manufacturing process in which (a) a double-layered coil 123 of tungsten wire with a wire diameter of 0.2 mm is fixed around a tungsten electrode rod 122 which has a shaft diameter of 0.4 mm (see FIG. 6A), and (b) next the tip of the tungsten electrode rod 122 and the tungsten double-layered coil 123 are fused so as to be a semi-sphere such as an electrode tip 124 (see FIG. 6B).

First, the following explains the electrode manufacturing method of the first embodiment of the present invention in detail. In the present embodiment, an argon plasma welding apparatus is used to perform a fusion process of the end tungsten electrode rod 122 and the tungsten double-layered coil 123 to form an electrode with a semi-sphere tip 124.

Figure 7:
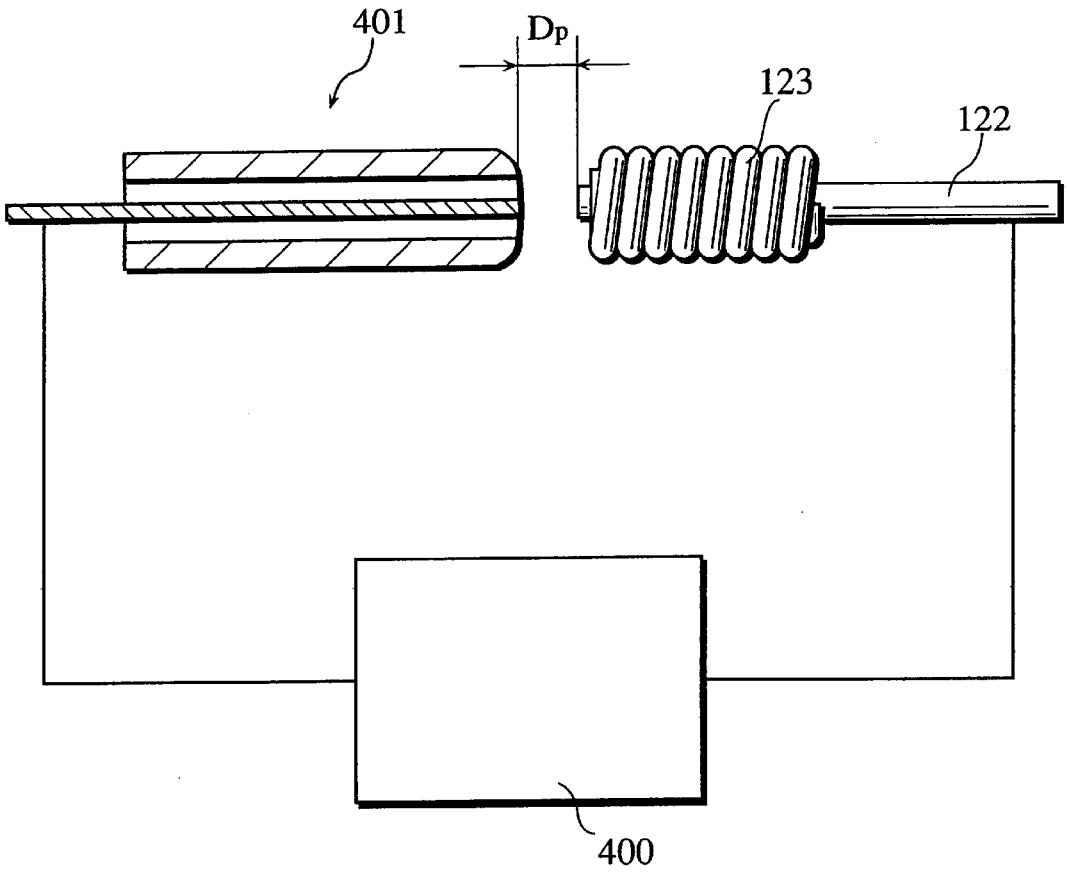
FIG. 7 is a drawing for explaining the usage pattern of the argon plasma welding apparatus 400 in the first embodiment.

Here, the fusion process performed by the argon plasma welding apparatus will be detailed. At this time, as shown in FIG. 7, a distance Dp from the tip of the tungsten electrode 122 and the double-layered coil 123 to the tip of an electrode (the cathode) 401 of an argon plasma welding apparatus 400 is set and maintained at 1.0 mm, and arc discharge is performed.

Figure 8:
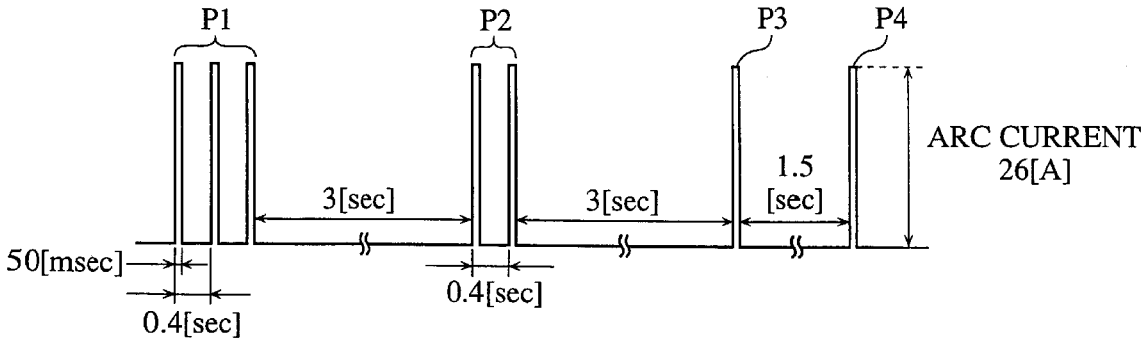
FIG. 8 is a waveform drawing showing an example of an electric discharge cycle of the argon plasma welding apparatus in the first embodiment.

This fusing process is performed by a plurality of intermittent arc discharges with at least one cooling period provided between the arc discharges. FIG. 8 shows a specific example of the fusing process. In this example fusion P1 to P4 is performed intermittently a total of four times with a cooling period provided between each fusion.

The first fusion P1 is done by performing arc discharge for 50 msec with a 26A arc current, three times continuously at 0.4 second intervals. The tip of the tungsten electrode 122 and the double-layered coil 123 is made into an approximate but not perfect semi-sphere according to this process.

Next, by leaving a cooling period of approximately three seconds, the tip of the tungsten electrode rod 122 and the double-layered coil 123 looses its red-hot state caused by the arc discharge and returns to a metal-colored state. Please note that the cooling in the present invention includes not only forced cooling by some kind of means, but also simply leaving the electrode to cool naturally. The cooling period between each fusion shown in FIG. 8 is natural cooling.

Next, fusion is performed for a second time. The second fusion P2 is done by performing arc discharge for 50 msec with a 26A arc current, twice continuously at a 0.4 second interval. According to this, the tip of the tungsten electrode 122 and the double-layered coil 123 is returned to the red-hot state, fuses and comes even closer to being perfectly semi-spherical.

Then, after a three second cooling period, a third fusion P3 is done by performing one arc discharge for 50 msec with an arc current of 26A. After a further cooling period of 1.5 seconds, a fourth fusion P4 is done by performing arc discharge once for 50 msec with an arc current of 26A. According to the fusions P1 to P4, the tip of the tungsten electrode rod 122 and the double-layered coil 123 is formed into a substantially perfect semi-sphere.

In this way, by performing fusion according to between one and a plurality of arc discharges while leaving cooling periods, temperature rise of the tip of the tungsten electrode 122 and the double-layered coil 123 is uniform overall, making fusion temperature control easy. According to this, an ideal electrode tip 124 that is semi-spherical and has no remaining defects such as holes or unfused sections can be obtained with stability.

Please note that it is desirable to set the total time of the cooling periods to be longer than the total time of the arc discharge over the whole fusion process. For example, in the example shown in FIG. 8, 50 msec arc discharge is performed 7 times, a total of 350 msec, while the total of the cooling periods, 7.5 seconds, is longer.

Please note that an example of a desirable fusion process is not limited to that in FIG. 8. It is possible to set conditions such as the number of and the intervals between arc discharges in each fusion, the length of the cooling periods, and the amount of arc current variously in ranges so as to achieve the objective of the invention.

Figure 9:
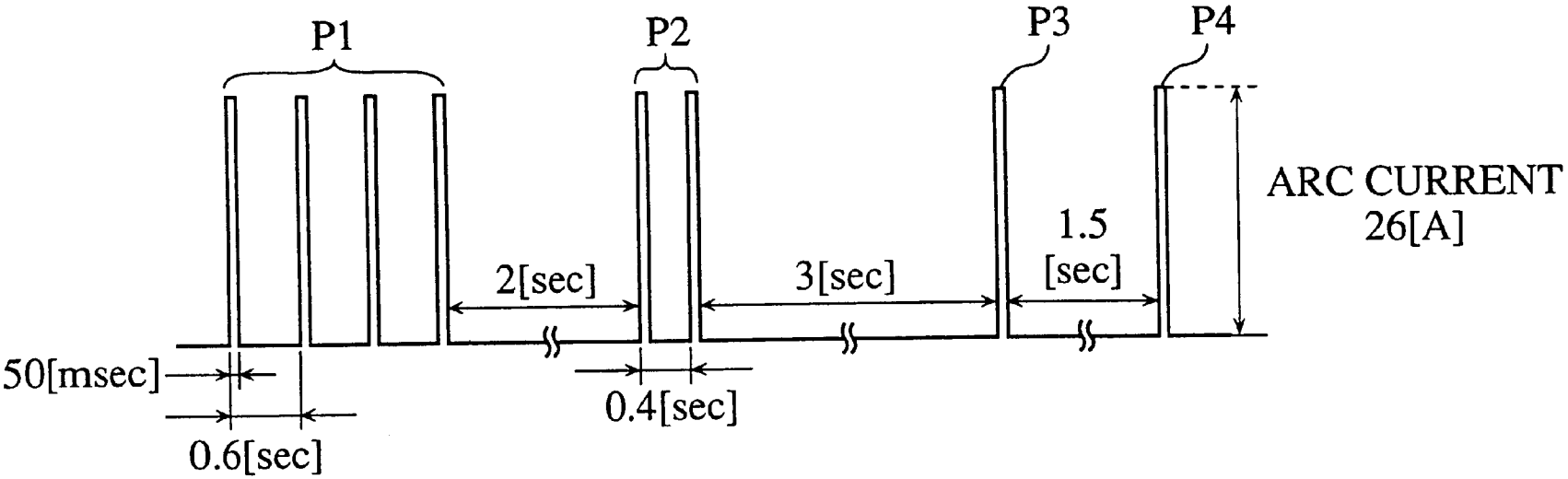
FIG. 9 is a waveform drawing showing another example of an electric discharge cycle of the argon plasma welding apparatus in the first embodiment.

For example, as shown in FIG. 9, it is possible to form the electrode tip 124 into an ideal semi-sphere without remaining defects such as holes or unfused sections even by a fusion process doing a first fusion P1 by performing arc discharge four times at 0.6 second intervals, leaving a 2 second cooling period, doing a second fusion P2 by performing arc discharge twice at a 0.4 second interval, leaving a 3 second cooling period, doing a third fusion P3 by performing arc discharge once, leaving a 1.5 second cooling period, and finally doing a fourth fusion P4 by performing arc discharge once.

Figure 10:
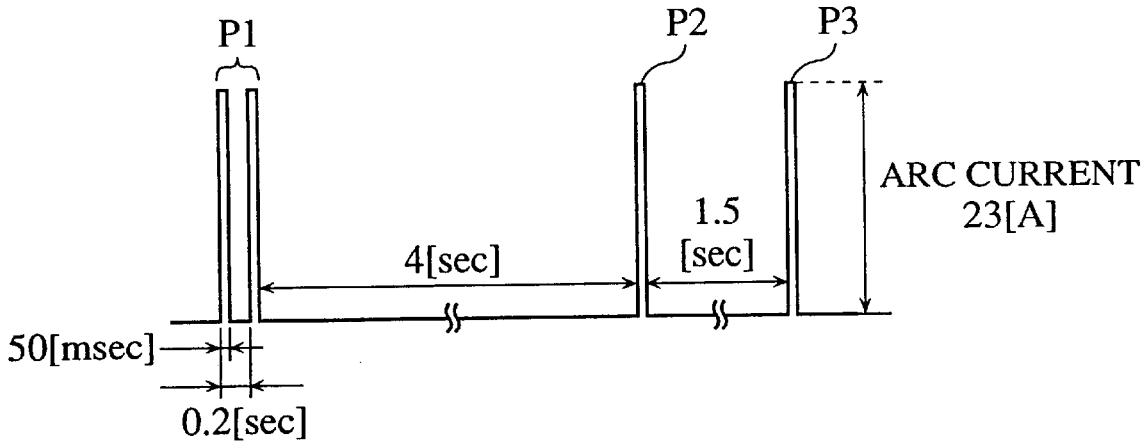
FIG. 10 is a waveform drawing showing yet another example of an electric discharge cycle of the argon plasma welding apparatus in the first embodiment.

Alternatively, while the probability of forming a perfect semi-sphere drops slightly, an electrode tip 124 which is within a permissible range may be obtained through a process in which, as shown in FIG. 10, a first fusion P1 is done by performing arc discharge twice at a 0.2 second interval (arc current 23A), after a 4 second cooling period doing a second fusion P2 by performing arc discharge once, and after a further cooling period of 1.5 seconds, doing a third fusion F3 by performing arc discharge once.

Please note that it is desirable to use so-called non-dope pure tungsten in which the total content of accessory constituents such as Al, Ca, Cr, Cu, Fe, Mg, Mn, Ni, Si, Sn, Na, K, Mo, U, and Th is restricted to 5 ppm or less as the material of the tungsten electrode 122 and the double-layered coil 123. Furthermore, in the above-described accessory constituents, it is desirable to limit the total content of alkaline metals Na and K, and Fe, Ni, Cr, and Al to 3 ppm or less.

The following explains a test and the results thereof that the present inventors performed on the high pressure mercury lamp of the present embodiment for investigating life characteristics such as the light flux maintaining rate during the life of the lamp.

To begin with, as a first test, the inventors investigated variations in life characteristics of high pressure mercury lamps of the present embodiment. Here, the test lamps used as the high pressure mercury lamps of the present embodiment were lamps constructed with the electrode 102 (and 103) whose tip 124 was formed according to the discharge cycle shown in FIG. 8. Furthermore, for the purpose of comparison, conventional high pressure mercury lamps were prepared and tested in the same way. Please note that the test lamp which was a conventional high pressure mercury lamp was constructed having electrodes 921 shown in FIG. 3B in place of the electrode 102 (and 103) of the high pressure mercury lamp of the present embodiment.

Figure 1:
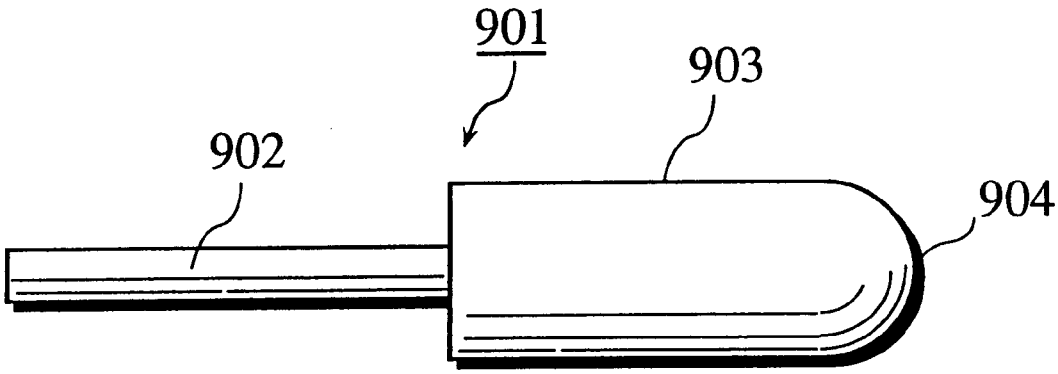
FIG. 1 shows an example of an electrode for a high pressure discharge lamp in the related arts
Figure 2:
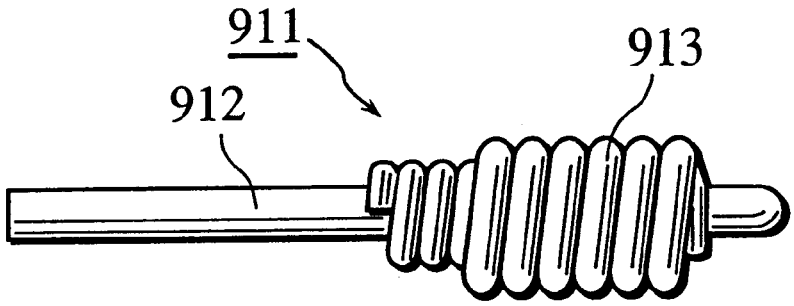
FIG. 2 shows and example of an electrode used in a conventional general lighting in a high pressure discharge lamp of the long arc type.
Figure 3A:
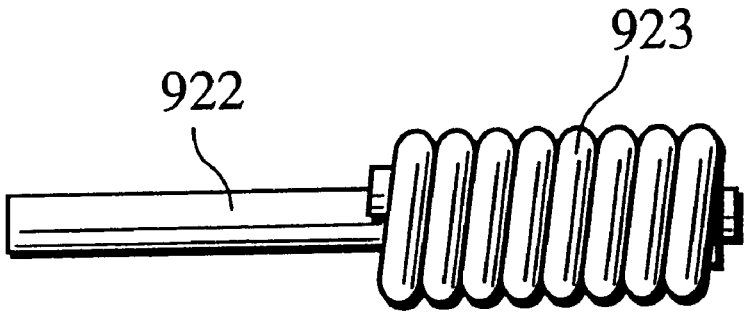
FIG. 3A and FIG. 3B are for explaining a conventional electrode formed with a semi-spherical electrode tip by winding a coil around the discharge end of the electrode rod and fusing the tip.

Please note that the electrodes 921 of the conventional test lamp were made through a manufacturing process in which, as shown in FIG. 3A, a double-layered tungsten coil 923 (having 8 turns) made from tungsten wire with a wire diameter of 0.2 mm was fixed on a tungsten electrode rod 922 with a shaft diameter of 0.4, then the tip of the tungsten rod 922 and the tungsten coil 923 was fused by an argon plasma welding apparatus so that the electrode tip 924 was formed into a semi-sphere as shown in FIG. 3B.

Please note that the fusing process of the electrode tip 924 was implemented by a conventional one-shot discharge arc process in which the tip of the tungsten rod 922 and the tungsten coil 923 is set and maintained with a distance Dp of 1.0 mm between the tip the tip of the electrode (anode) 401 of the argon plasma welding apparatus shown in FIG. 7, and arc discharge performed only once with an arc current of 20A.

Furthermore, a so-called non-doped high-purity tungsten in which the maximum of the total content of the above-described composition of the accessory constituents was restricted to 10 ppm of the tungsten was used as the material of the tungsten rod 922 and the tungsten coil 923. Meanwhile, the material of the electrodes 102 and 103 of the test lamp of the lamp of the present embodiment was a tungsten of even higher purity in which the total content of the above-described accessory constituents was 5 ppm, while the total content of alkaline metals Na and K, and Fe, Ni, Cr, and Al contained in these accessory constituents was 3 ppm.

Please note that during the test for all test lamps the output was set at 150W, and the dimensions of the light-emitting tube were: the maximum outer diameter Do of the center part of the tube (see FIG. 4) 9.4 mm, and the greatest internal diameter Di of the tube (see FIG. 4) 4.4 mm. Furthermore, the distance De between the electrode tips was 1.1 mm, the internal tube volume was 0.06 $cm^3$, and the tube length Lo (see FIG. 4) was 57 mm. Furthermore, 11.4 mg of mercury (tube volume comparative mass 190 $mg/cm^3$, equivalent to mercury vapor pressure 190 bar during illumination) and 200 mbar of argon were sealed in the tube.

Several of both of the high pressure mercury lamp of the present embodiment and the conventional mercury lamp according to the above-described criteria were prepared, each assembled to make lamp units such as the lamp unit 300 shown in FIG. 5, and life tests were performed according to aging through a 3.5 hours illumination/0.5 hours off cycle. Furthermore, the average value of the brightness of the center of nine points on a screen from the lamp unit 300 is obtained, and based on the result, average brightness maintaining rate (the ratio of average brightness over a 3 hour aging time) is measured based on the ANSI Standard IT7.215-1992 as the light flux maintaining rate during lamp life.

Figure 11:
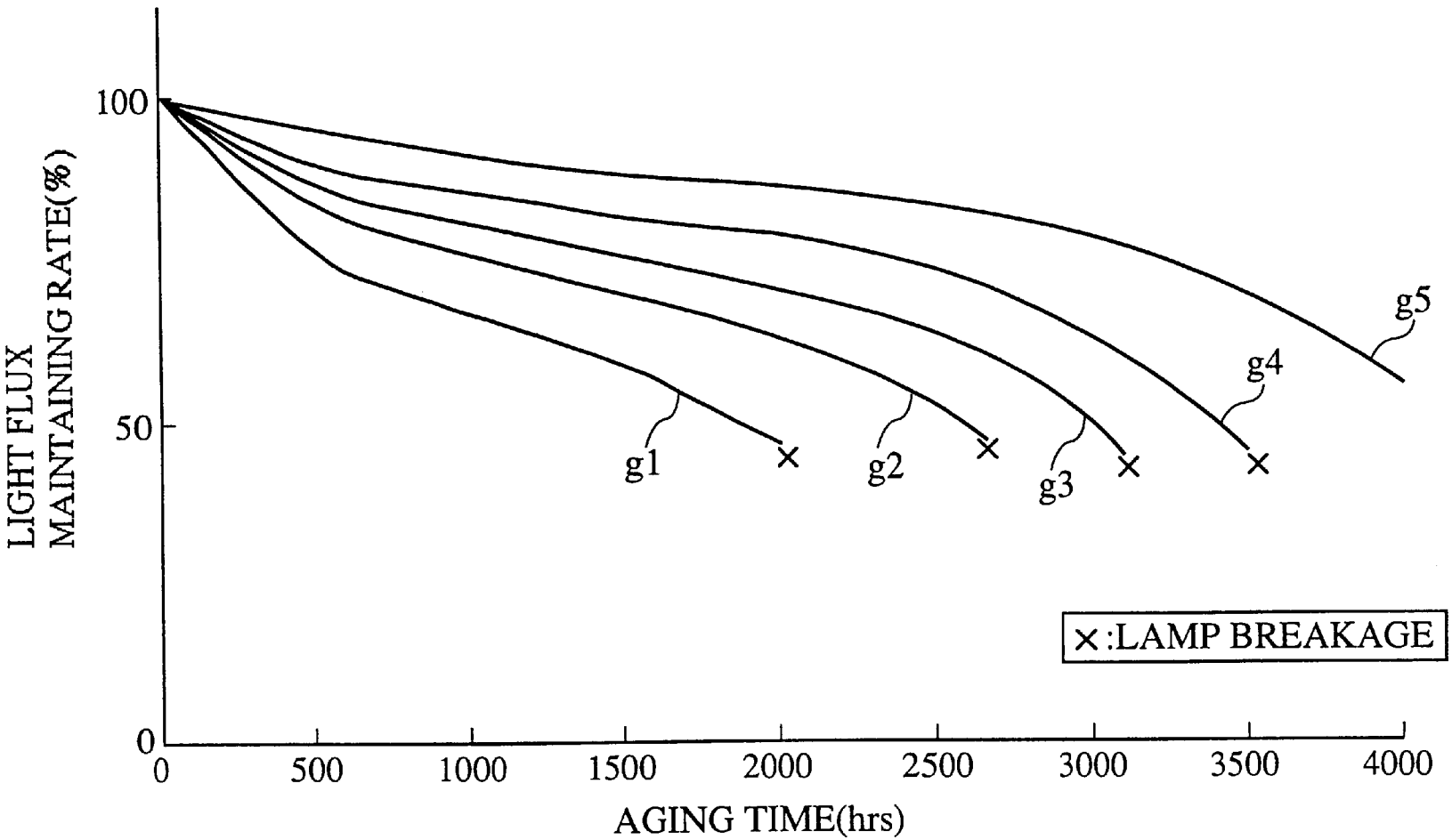
FIG. 11 is a drawing showing variations in light flux maintaining rate over aging time of high pressure discharge lamps of the first embodiment.
Figure 12:
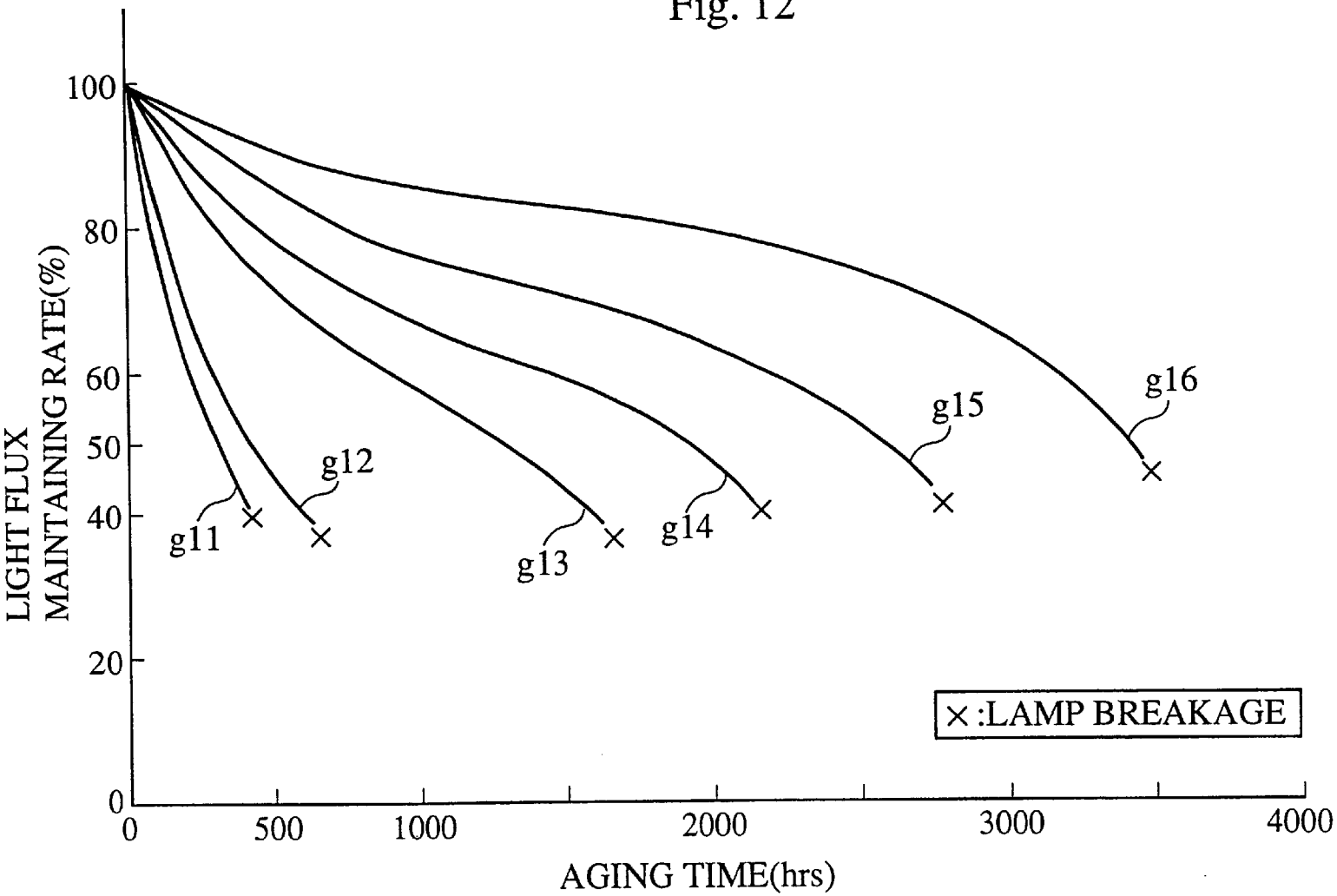
FIG. 12 is a drawing showing variations in light flux maintaining rate over aging time of conventional high pressure discharge lamps as an example of comparison.

The results of the life test performed according to the above conditions are shown in FIG. 11 and FIG. 12. The life characteristics of the test lamps prepared as lamps of the present embodiment (hereafter "present embodiment test lamps") are shown in FIG. 11, and the life characteristics of the test lamps prepared as conventional lamps (hereafter "conventional test lamps") are shown in FIG. 12.

As can be seen from FIG. 11, none of the present embodiment test lamps have a light flux maintaining rate which falls below 50% in 500 hours of aging time. In particular, lamps whose characteristics are shown by g3, g4, and g5 maintain a light flux maintaining rate of 50% or more even after at least 3000 hours of aging time. In other words, these lamps have a life of at least 3000 hours.

Meanwhile, as can be seen from FIG. 12, the conventional test lamps have a large variety of life characteristics between lamps, ranging from lamps (g11 and g12 in the graph in FIG. 12) which have characteristics in which the light flux maintaining rate drops greatly to a level less than 50% in 500 hours of aging time, through to a lamp (g16 in the graph) which maintains a light flux maintaining rate of a high level of more than 50% for 3000 hours of aging time.

In this case, uniform blackening of the light-emitting tube, and a loss of transparence of the quartz of the light-emitting tube (whitening phenomenon due to recrystallization of the quartz)as the aging time became longer exceeding 1000 hours, was observed in lamps whose light flux maintaining rate dropped. The lamps whose light flux maintaining rate fell below 50% as blackening or loss of transparence proceeded, suffered a rise in temperature and an expansion of the light-emitting tube, particularly the upper part, and broke. Please note that in FIG. 11 and FIG. 12 a cross (X) shows the point at which each test lamp broke.

Figure 13A:
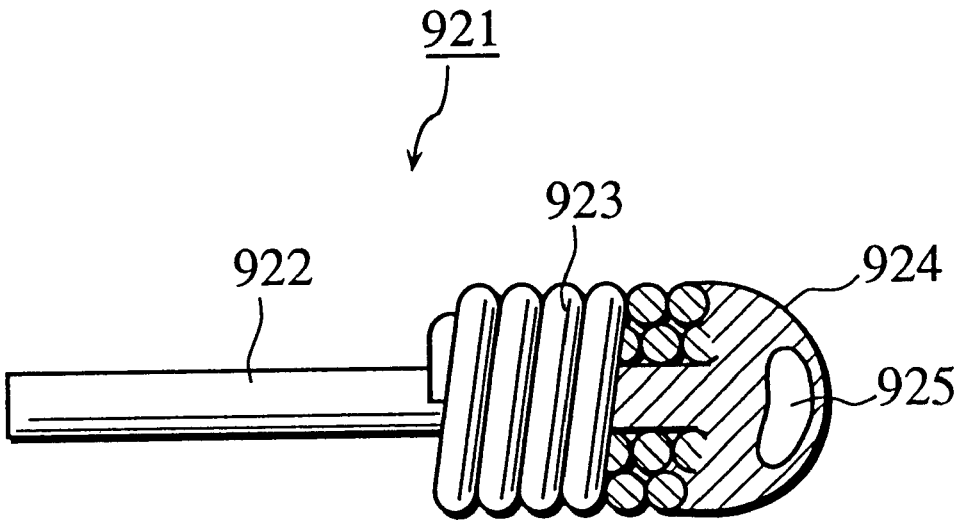
FIG. 13A and FIG. 13B are partial cross sections showing defects in the electrode tip that occur in conventional high pressure discharge lamps.
Figure 13B:
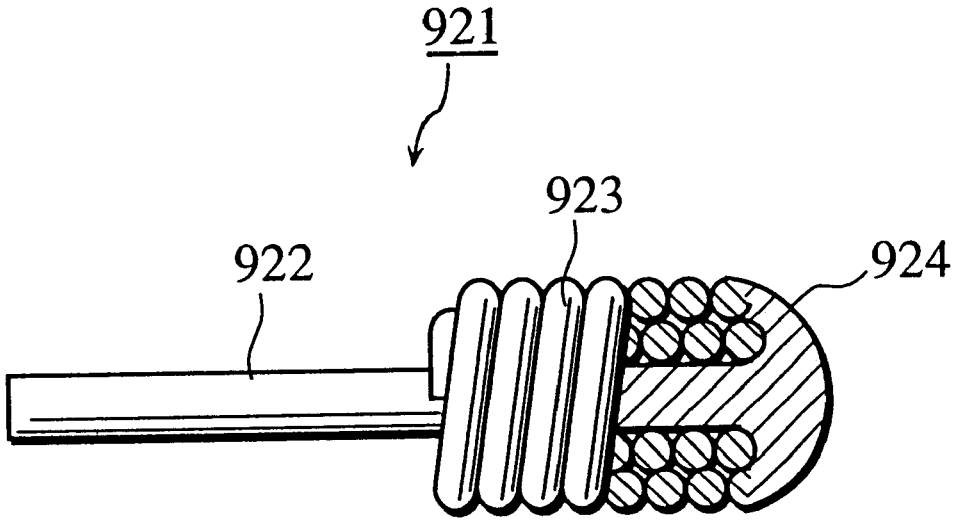

In addition, when electrodes of the test lamps were disconnected and investigated after the life test, it was discovered that in particular the fusing states of the electrode ends of the test lamps (conventional lamps) whose light flux maintaining rate dropped below 50% in a short aging time of 500 hours or less were not uniform. Namely, defects based on the fusion process, for example as shown in FIG. 13A, a hole in the fused semi-sphere tip 924, and as shown in FIG. 13B, sections of places of the tungsten coil 923 which should be part of the semi-sphere 924 which remained unfused.

The reason that these kinds of defects occur is as follows. Namely, control of the optimum fusing temperature in one-shot discharge arc fusion which is employed conventionally when fusing electrode ends is difficult. In particular, holes and unfused sections remain due to the temperature of electrode ends locally rising suddenly and excessively.

In contrast, the fusing process to form the semi-sphere of the electrode tip 124 of lamps of the present embodiment is not the conventional one-shot arc discharge method, but is performed intermittently between one and a plurality of arc discharges, while providing a cooling period between each fusing. Therefore, the temperature rise of the electrode end is uniform overall and temperature control is easy. According to this defects such as holes and unfused sections do not remain in the tip 124 of the electrode 102 (and 103), and the lamp shows superior life characteristics.

Furthermore, as for test lamps whose light flux maintaining rate dropped below 50% during 1000 to 3000 hours of aging time in the above-described test (g13 to g15, FIG. 12), the fusion state of the tip 924 of the electrode 921 looked uniform and appropriate at a glance, but when the tungsten crystallization state was investigated in detail, the grain size in the tungsten crystals was found to be smaller than that of the electrodes of the test lamp which maintained a light flux maintaining rate of at least 50% even for 3000 hours of aging time.

Figure 14:
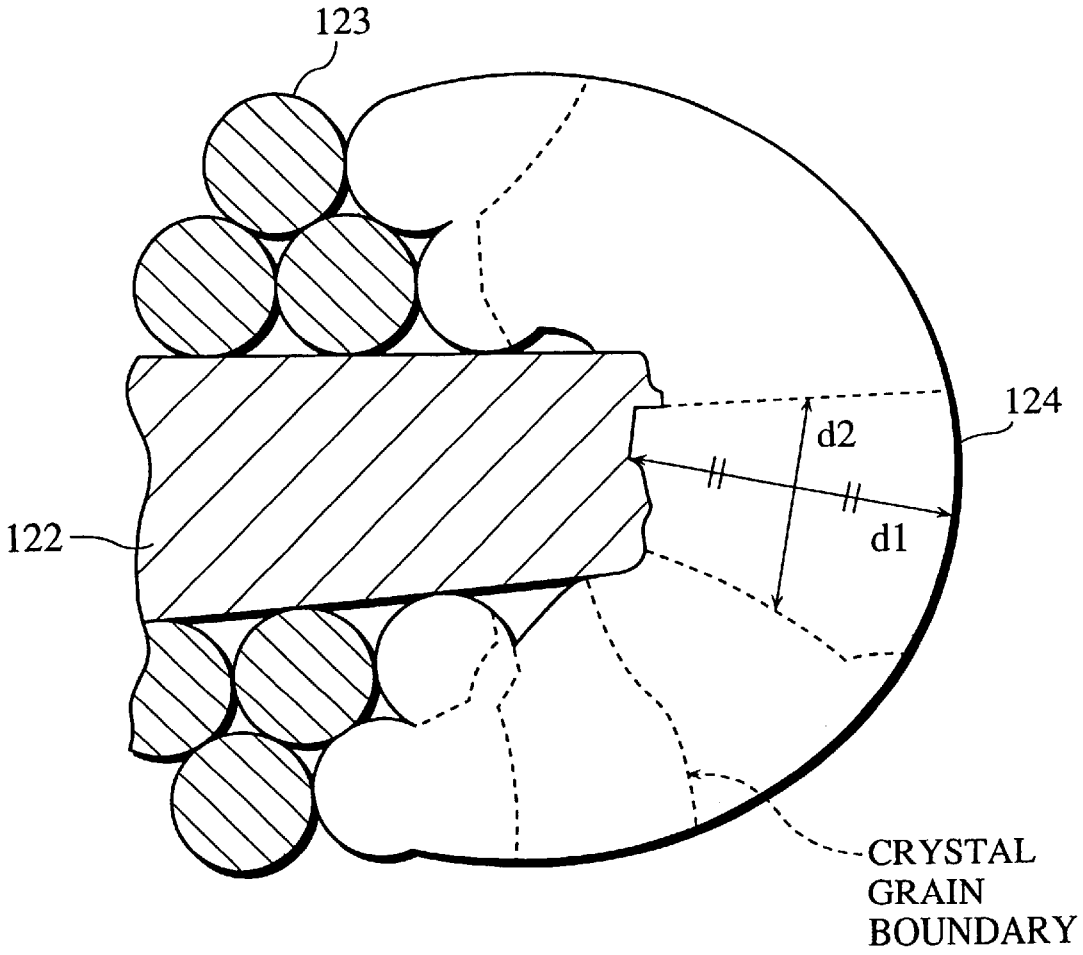
FIG. 14 is a cross section of an example of tungsten crystallization on the tip 124 of an electrode for a high pressure discharge lamp of the present invention.

The crystallization in the electrode tip ordinarily grows radially such as shown in FIG. 14 in the fusing process, and the grain size in the crystallization depends on the conditions of the fusing process. Please note that the average grain diameter in the tungsten crystallization is defined as the average value of a longest length dimension d1 in the radial direction and a dimension d2 which is a perpendicular line crossing d1 at the halfway point of d1. It is extremely difficult to derive a unique correlation between each condition in the fusing process (such as strength of the arc current, length of the discharge time, number of arc discharges in each fusion and the interval therebetween, and the length of the cooling period). However, the inventors found that basically the higher the temperature during fusion and the longer the fusion time, the bigger the grain size in the crystallization.

Consequently, the inventors performed a second test to investigate the correlation between the average grain size in the tungsten crystallization of the electrode tip (an average value of a plurality of representative crystals) and the life characteristics such as light flux maintaining rate. Electrode samples with differing fusion states and tungsten crystallization states (grain diameters) were made by changing various conditions within a range that satisfies two conditions of the fusion process of the electrode ends of the lamps (i) performing fusion a plurality of times by at least one arc discharge between one and a plurality of times intermittently, and (ii) providing a cooling period between fusions. These electrodes were used in the second test.

Please note that in the second test the total content of the above-described accessory constituents was 5 ppm, while the total content of alkaline metals Na and K, and Fe, Ni, Cr, and Al contained in these accessory constituents was 3 ppm.

Figure 15:
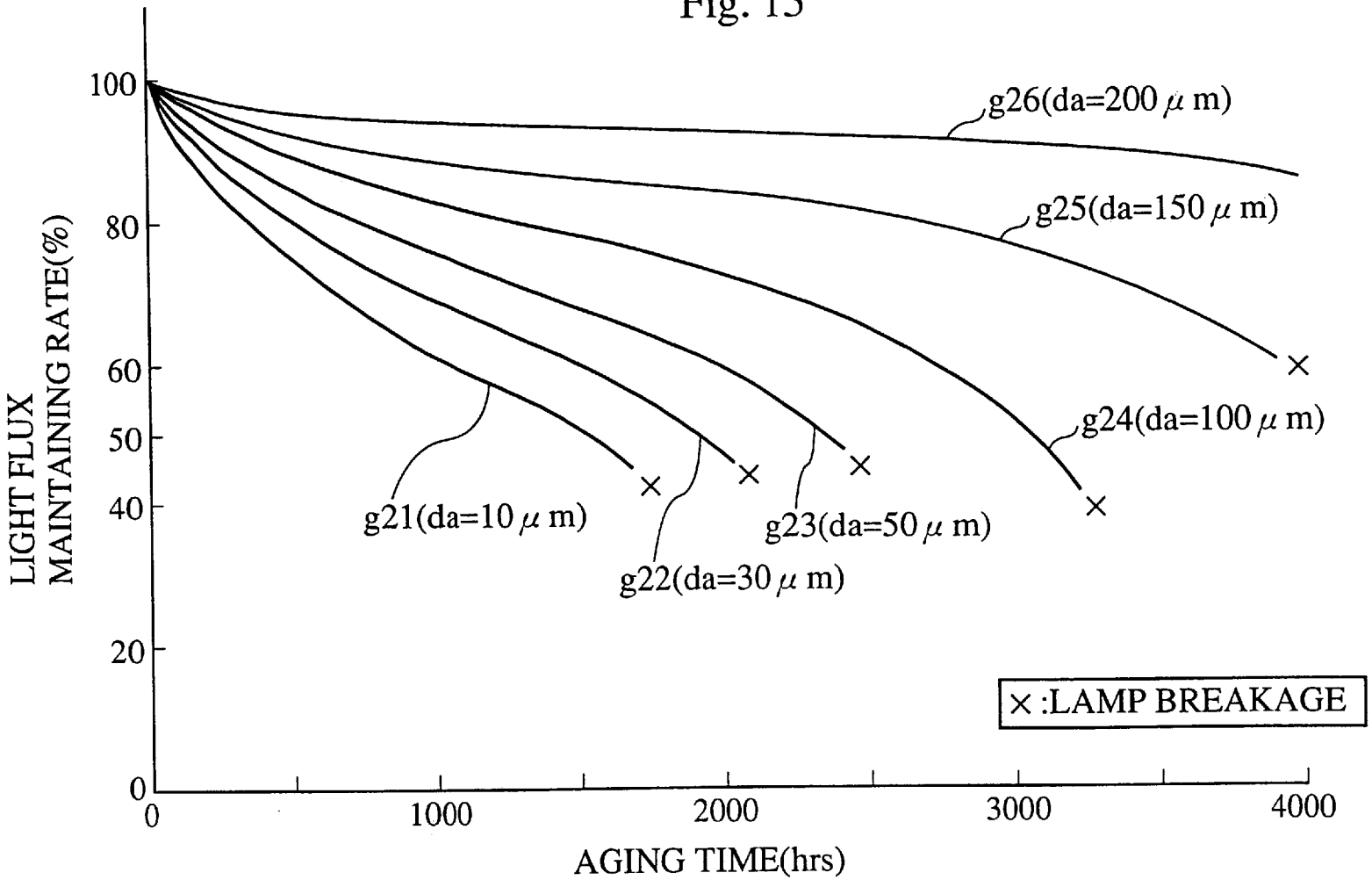
FIG. 15 is a drawing showing variations in light flux maintaining rate over aging time of high pressure discharge lamps, each having a different average grain diameter in the tungsten crystallization of the electrode tip 124.

The results of the second test, as shown in FIG. 15, confirm that the bigger the average grain diameter da of the tungsten crystallization of the electrode tip, the better life characteristics obtained. In particular, it was confirmed that when an average crystal diameter of a test lamp is 100 $\mu$m or more (g24 to g26 in FIG. 15) the improvement effect on life characteristics increases dramatically and a favorable light flux maintaining rate of at least 50% over an aging time of 3000 hours is maintained. In other words, if the average grain diameter is 100 $\mu$m or more, a high pressure mercury lamp which has a life of at least 3000 hours can be obtained.

Furthermore, it was confirmed that when the value of the average grain size is 200 $\mu$m or more (g26 in FIG. 15) an even higher level of light flux maintaining rate, at least 50% from an aging time of 6000 hours (in other words a life of at least 6000 hours) can be achieved.

For example, although not shown in FIG. 15, when the average grain diameter da in the tungsten crystallization of an electrode tip fused according to the discharge cycle shown in FIG. 8 is 200 $\mu$m, a lamp light flux maintaining rate of 51% was obtained after an aging time of 6000 hours. Furthermore, in the same way, when fusion was performed with the discharge cycle shown in FIG. 9, favorable characteristics were obtained when the average grain diameter da in the tungsten crystallization of the electrode tip was 200 $\mu$m.

Furthermore, it was confirmed that blackening of the light-emitting tube 101 is suppressed when the average grain diameter in the tungsten crystallization is larger. Therefore, the reason for the improvement in the lamp light flux maintaining rate is the suppression of dispersion of tungsten from the electrode tip which causes blackening of the light-emitting tube. In addition, another reason for improvement of light flux maintaining rate is that the bigger the diameter of the crystals of the electrode end, the better the heat conductivity is, therefore the conduction of heat to the rear of the electrode is accelerated, reducing the heat of the electrode end.

Furthermore, the inventors performed a third test using high pressure discharge lamps of the present embodiment, the fusion of the electrodes of which was performed according to the discharge cycle shown in FIG. 8, in order to investigate the correlation between the purity of the tungsten material of the electrode and the lamp light flux maintaining rate. The results are shown in FIG. 16.

Figure 16:
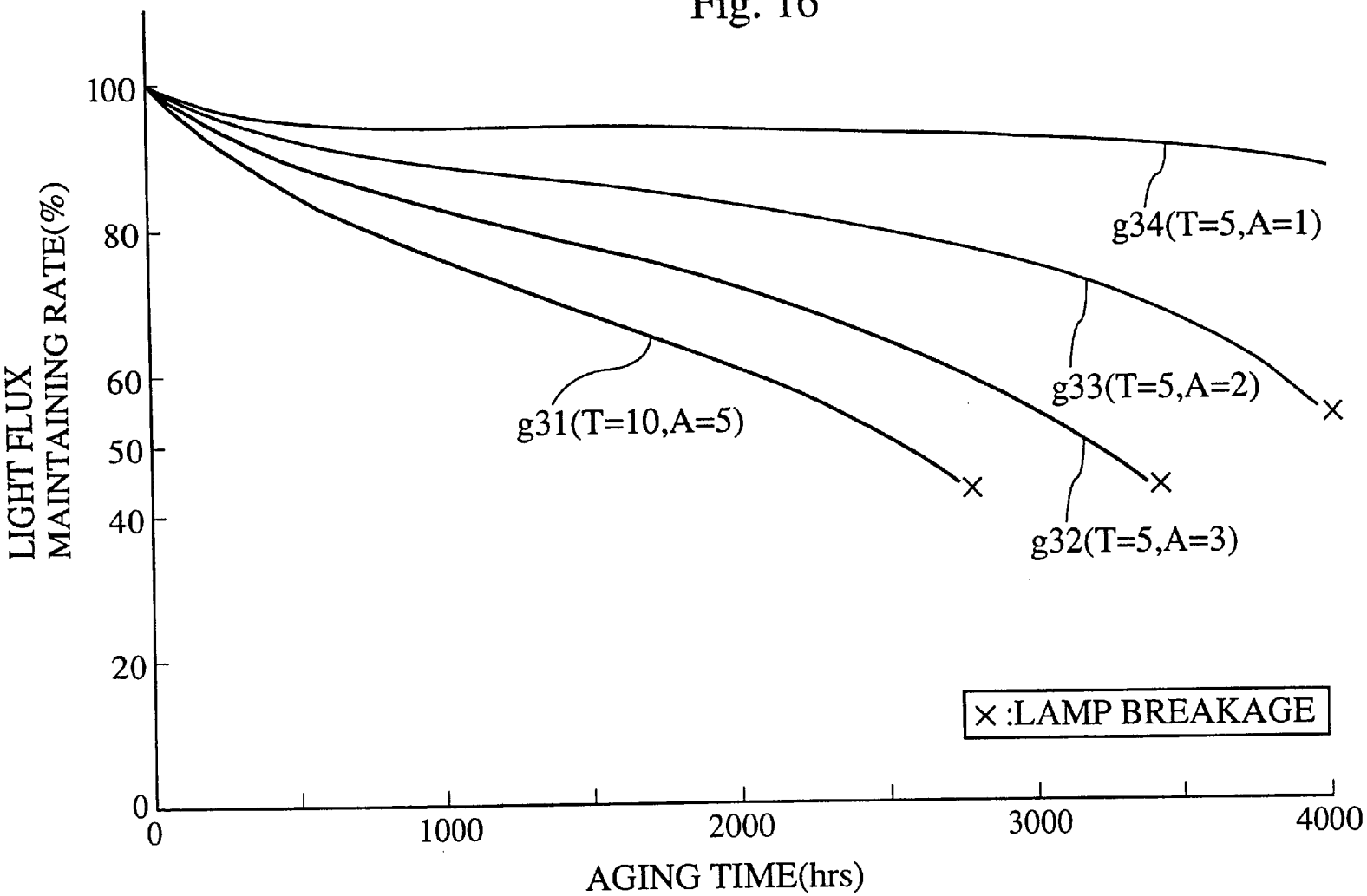
FIG. 16 is a drawing showing variations in light flux maintaining rate over aging time of high pressure discharge lamps, each having a different ratio of accessory constituents and of specified metals in the accessory constituents of the electrode material.

In FIG. 16, T is the total content (unit: ppm) of the accessory constituents in the electrode material of the each test lamp. A indicates the total content (unit: ppm) of alkaline metals Na and K, and Fe, Ni, Cr and Al in the accessory constituents. For example, in the case of the test lamps whose characteristics are shown by g31, the total content of the accessory constituents of the electrode material is 10 ppm, and amongst this the sum total of alkaline metals Na and K, and Fe, Ni, Cr, and Al is 5 ppm.

As can be seen from FIG. 16, the lamp light flux maintaining rate improves as the sum total of the accessory constituents is reduced to less than 10 ppm, in particular, the reduction of alkaline metals Na and K, and Fe, Ni, Cr, and Al in the accessory constituents has a great effect on the improvement of the light flux maintaining rate. In particular, it was confirmed that in order to make the lamp life (the aging time until the light flux maintaining rate falls to less than 50%) 3000 hours or more, it is desirable to reduce alkaline metals Na and K, and Fe, Ni, Cr, and Al in the accessory constituents to 3 ppm or less.

Two effects which the accessory constituents in the tungsten electrode material have on the lamp life characteristics are (i) the amount of halogen which is essentially necessary for the working of the halogen cycle for suppressing blackening of the light-emitting tube is insufficient due to accessory constituent matter such as alkaline metals which disperses from the tungsten material according to aging reacting with the sealed halogen, and (ii) part of the vaporized accessory constituent matter reacts with the quartz of the light-emitting tube and becoming crystal nuclei for recrystallization, causing acceleration of loss of transparency of the quartz.

As confirmed in the above-described third test, in the high pressure mercury lamp of the present embodiment, both the blackening of the light-emitting tube due to aging and the loss of the transparency of the light-emitting tube quartz can be suppressed by using high purity tungsten electrodes whose total content of the accessory constituents other than tungsten in the electrode material and total content of specific metals such as alkaline metals in the accessory constituents are reduced.

Second Embodiment

Next a second embodiment of the present invention will be explained.

As explained in the first embodiment, it is possible to suppress variations in the shape of the electrode tip by performing an intermittent heating fusing even by discharge arc fusion, but the inventors, estimated that a laser processing method would be superior in principle after further analyzing an electrode manufacturing method having a higher degree of accuracy than the method of the first embodiment. Namely, it was estimated that variations in fused shapes and dimensions could be reduced because a laser beam used in a laser processing method can irradiate on the electrode tip 124 controlling irradiation position and output more accurately.

Thus the inventors performed an investigation of an electrode manufacturing method according to a laser processing method. Lasers such as $CO_2$ lasers, and laser diodes (LD, semiconductor lasers) are appropriate for use in metal processing, but the inventors chose to use an Nd-YAG pulse laser which irradiates a wavelength of 1064 nm. Specifically, an investigation was performed of the manufacturing process conditions of the above-described laser fusing method which can further increase accuracy when fusing and processing the electrode tip 124. Next, the inventors prepared test lamps which use electrodes made according to the laser processing method actually under this kind of manufacturing process conditions, and measured the lamp characteristics such as lamp voltage and light flux maintaining rate. Furthermore, at the same time the inventors observed the fused shape and dimensions of the fused electrode tip 124 and investigated the correlation between the measured lamp characteristics.

Figure 17:
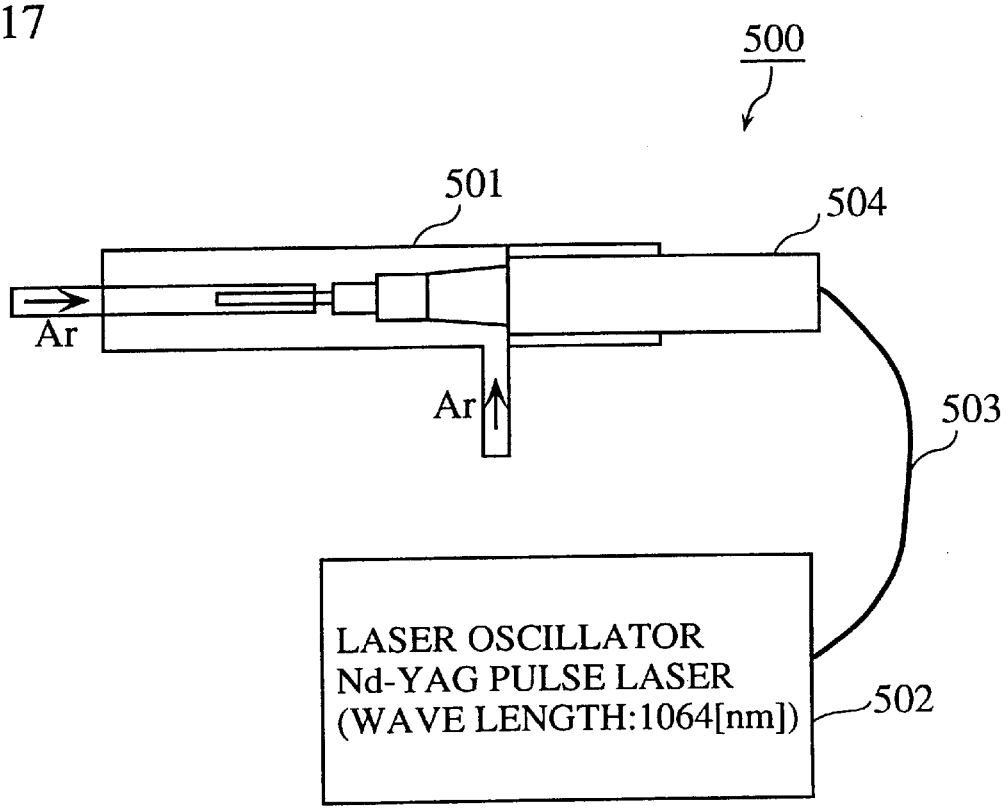
FIG. 17 is a drawing showing an diagrammatic structure of the Nd-YAG laser fusing apparatus 500 used in the fusing of the electrode tip 124 in the second embodiment.

FIG. 17 shows a diagrammatic structure of an Nd-YAG laser fusing apparatus 500 used in the fusing of the electrode tip 124 in the present embodiment. Please note that in FIG. 17 501 is a chamber inside which an electrode is set, 502 is an oscillator of the Nd-YAG pulse laser of a wavelength of 1064 nm, 503 is an optical fiber, and 504 is an optical system.

Here, the fusing of the electrode tip 124 is performed according to two manufacturing processes: (1) a tungsten electrode rod 122 around which a double-layered tungsten coil 123 is fixed is set in the chamber 501 which has an argon atmosphere, and (2) fusion processing is done by performing laser irradiation on the tip of the tungsten electrode rod 122 and the double-layered tungsten coil 123.

Please note that excluding the electrode fusing method, the specific lamp design of the test lamps used in the present investigation is the same as in the first embodiment. Namely, the lamp input is set at 150W, and the dimensions of the light-emitting tube were: the maximum outer diameter Do of the center part of the tube (see FIG. 4) 9.4 mm, and the greatest internal diameter Di of the tube (see FIG. 4) 4.4 mm. Furthermore, the distance De between the electrode tips was 1.1 mm, the internal tube volume was 0.06 $cm^3$, and the tube length Lo (see FIG. 4) was 57 mm. Furthermore, 11.4 mg of mercury (tube volume comparative mass 190 $mg/cm^3$, equivalent to mercury vapor pressure 190 bar during illumination) and 200 mbar of argon were sealed in the tube. Please note that in the present embodiment so-called non-doped high purity tungsten of which the upper value of the total content of the above-described accessory constituents in the tungsten is restricted to 10 ppm was used as the material for the tungsten electrode rod 122 and the tungsten coil 123, however, naturally it is more desirable to use an even purer tungsten in which the total content of the accessory constituents is 5 ppm while the total content of the alkaline metals Na and K, and Fe, Ni, Cr, and Al therein is 3 ppm, in the same way as the first embodiment.

Furthermore, measurement of characteristics such as the life test and the light flux maintaining rate of the test lamps was performed in the same manner as in the fist embodiment. Namely, the life test of the test lamps was performed by assembling the lamp unit 300 shown in FIG. 5, and performing aging through a 3.5 hours illumination/0.5 hours off cycle. Furthermore, the average value of the brightness of the center of nine points on a screen from the lamp unit 300 is obtained, and based on the result, average brightness maintaining rate (the ratio of average brightness over a 3 hour aging time) is measured based on the ANSI Standard IT7.215-1992 as the light flux maintaining rate during lamp life.

Figure 18:
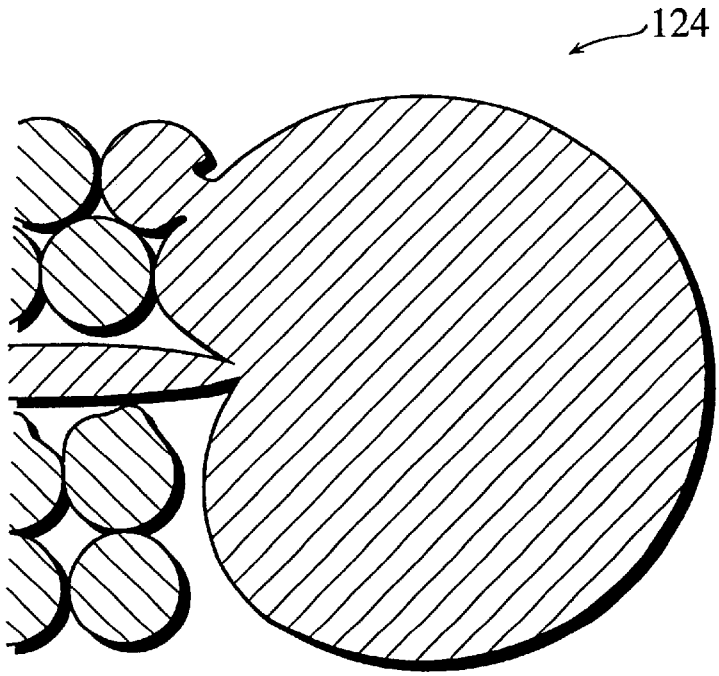
FIG. 18 is a cross section showing an example of the appearance of the area around the electrode tip 124 fused by performing laser irradiation continuously.

First, FIG. 18 shows the results when laser irradiation was performed continuously as one manufacturing process condition according to the laser processing method. As shown in FIG. 18, the fused shape of the electrode tip 124 is closer to a sphere than a semi-sphere, therefore this process is inappropriate as a fusing method of the electrode tip 124. This is because when laser irradiation is performed continuously the processing temperature of the electrode end rises sharply and excessively and the electrode tip 124 melts too much.

Based on the above findings, the inventors discovered that it is more suitable as a manufacturing process condition to repeat laser irradiation a predetermined number of times at predetermined intervals. This is the basic manufacturing process in the laser fusing method of the present embodiment. According to this process, when the fusing of the electrode tip 124 is performed the processing temperature can be controlled within an appropriate range, therefore it is possible to adjust the electrode tip 124 so the shape becomes even closer to being a semi-sphere.

Figure 19:
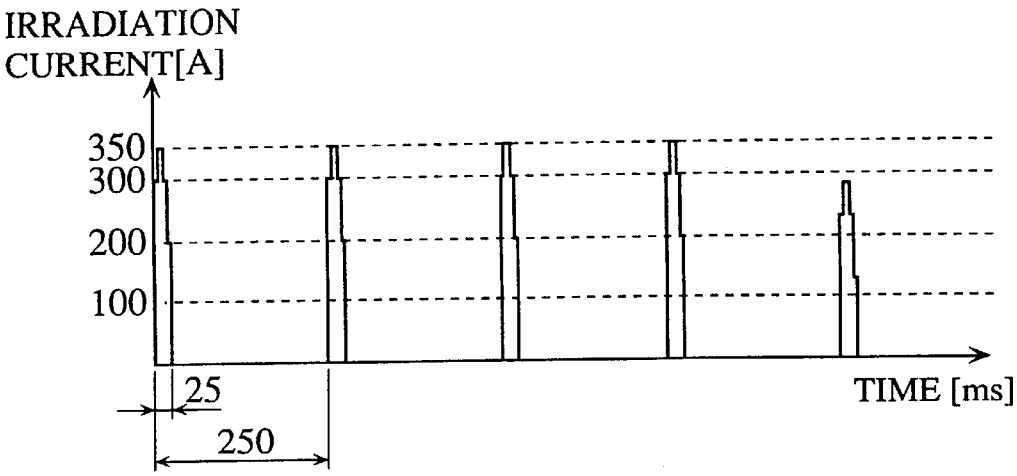
FIG. 19 shows a typical example of the laser irradiation cycle set by the present inventors based on the basic manufacturing process conditions of the electrode manufacturing method of the second embodiment.

Please note that it was discovered that a range of 1 Hz to 20 Hz is appropriate for the repeat frequency regulating the time intervals of the laser irradiation in this case. It is possible to control this repeat frequency by a publicly known method in the laser oscillator 502. FIG. 19 shows a typical example of the laser irradiation cycle that the inventors set based on the basic manufacturing process conditions of the electrode manufacturing method of the present embodiment. The example shown in FIG. 19 is an example of when fusing is performed irradiating intermittently with a repeat frequency of 4 Hz a total of five times. Please note that in the first embodiment the fusing temperature was controlled by the number of arc discharges, but in the present embodiment the same effect is achieved by adjusting the output of the laser. In other words, in the example in FIG. 19, in the last (fifth) laser irradiation the laser output is slightly lower than the laser output of the previous irradiations, but, this is because recrystallization with annealing happens, the same effect as controlling by the number of arc discharges. Indeed, setting control of the intervals between intermittent laser irradiations may be performed in the same way as the first embodiment.

Furthermore, as another method of performing recrystallization with annealing besides lowering the laser output in the last irradiation compared to the other irradiations, the laser ouput of a plurality of last laser irradiations may be lowered gradually.

Figure 20:
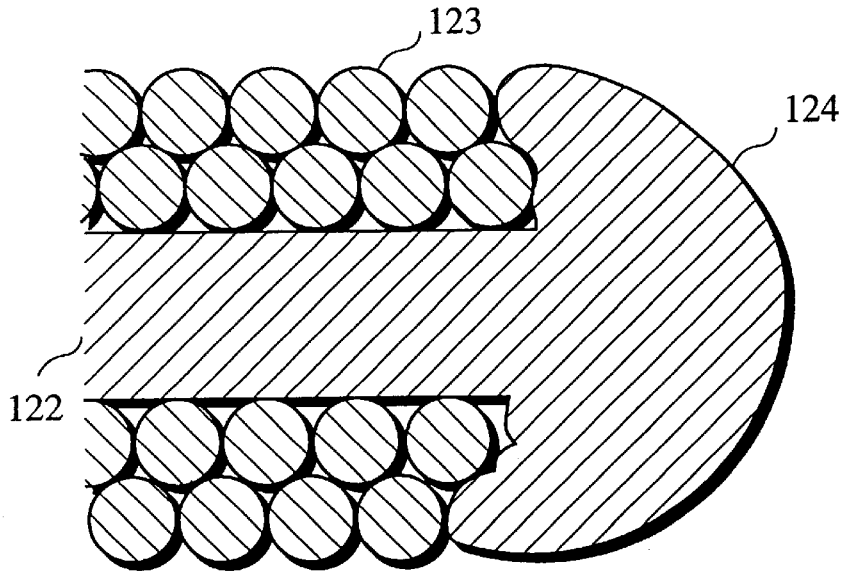
FIG. 20 is a cross section of the area around the electrode end 124 fused by performing laser irradiation five times intermittently with a repeat frequency of 4 Hz, as shown in FIG. 19.

FIG. 20 shows an example of the fused shape of the electrode tip 124 in this case. As shown in FIG. 20, as a result of the laser processing method in which intermittent laser irradiation is performed, it was confirmed that the processed shape of the electrode tip 124 is substantially a semi-sphere while the variations in the fused dimensions were suppressed and improved. Please note that it was also confirmed that an average grain diameter in the crystallization of at least 200 $\mu$m was realized.

Next the results of a test performed with a main objective of detecting variations in lamp characteristics between a plurality of lamps which were made using electrodes whose electrode tips 124 were melted and processed using the above-described laser processing method for the test, will be explained.

In the present investigation first a lamp voltage Vla was measured after one hour of aging time. As a result it was revealed that the variation in lamp voltage between the plurality of lamps was reduced to Vla=61±5V. This kind of suppression of variation control is thought to be a result of the accuracy of fusing of the electrode 124 increasing, making the shape and the measurements become more uniform. If such an electrode is used variations in the distance De between electrodes can be substantially reduced. Namely, when there are variations in the shape of the electrode tip 124, the discharge arc during illumination is removed from the central axis between both electrodes meaning that substantially the distance De between electrodes is longer than the design value, and the lamp voltage may increase beyond the original rating value range. However, it has been shown that such variations can be reduced by using the method of the present embodiment.

Meanwhile, when a light flux maintaining rate $\phi$la was measured after 3000 hours of lamp aging time, the result was $\phi$la=78±8%, showing that variation between lamps is reduced. Therefore, it was confirmed that the objective of a lamp life of 3000 hours or more set by the inventors had been realized more certainly.

Please note that the improvement in variations in light flux maintaining rate is also though to be due to the fused shape and dimensions of the electrode tip 124 becoming more uniform, the variation in electrode temperature during illumination between the plurality of lamps, and the state of vaporization of the tungsten matter fluctuating comparatively less between lamps.

As explained above, by manufacturing an electrode by a laser fusing method which uses process conditions in which the fusing of the electrode tip 124 is done by performing a predetermined number of laser irradiations intermittently, the electrode tip is more certainly fused to be a semi-sphere, and variations in the shape and dimensions are suppressed between lamps. Therefore, it was confirmed that it is possible to even more surely improve life of a high pressure discharge lamp even with an arc length shorter than conventional lamps.

Variations

The present invention has been explained based on various embodiments but the contents of the present invention are of course not limited to the specific examples shown in the above-mentioned embodiments; for example the following variations are possible.

(1) Namely, in both of the above-described embodiments the lamp output is set at 150W, but it is possible to apply the method of manufacturing of the present invention to other lamp input goods. It is possible that there may be cases in which it is necessary to change characteristics such as the shaft diameter of the electrode rod 122 or the wire diameter of the coil 123, but in such cases conditions such as the amount of and interval between arc discharge, the length of the cooling time, and the strength of the arc current (in the case of processing by arc discharge), and conditions such as the output of laser irradiation and the repeated frequency (in the case of laser irradiation), maybe changed accordingly. In view of the principles of the intermittent discharge arc and the laser fusing, and based thereon the reasons that variations in fused shape and dimensions can be suppressed explained above, it can be said that the process conditions discovered by the inventors, namely, the optimization on each condition within the range of the present invention in which intermittent heating fusing is performed, can be performed easily ordinarily.

(2) Furthermore, in the above-described second embodiment an example was shown of a repeat current of 4 Hz, namely, an example in which the time intervals between the laser irradiations were a set length, (see FIG. 19). This is desirable because the control circuit in the laser oscillator 502 can be easily constructed, but the time intervals between the laser irradiation do not have to be a set length, but may be different, as shown above, for the first few times of laser irradiation and the succeeding times.

(3) Furthermore, in both the above-described embodiments the two layer coil 123 was wound around the electrode rod 122, but the member that covers the electrode rod 122 at the discharge end is not limited to a coil, but for example, a member such as a tube shaped member can be used. Furthermore, the coil does not have to be double-layered, nor have 8 turns.

(4) Furthermore, in both the above-described embodiments tungsten is used as the main constituent of the material of the electrode rod 122 and the coil 123, but these can be applied to electrodes using other refractory metals as their main constituent.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A method for manufacturing a high pressure discharge lamp, the method comprising:

a covering member applying step for applying a covering member made of refractory metal on a discharge side end of an electrode rod made of refractory metal so as to cover a circumference of the electrode rod in a vicinity of the discharge side end, and a fusing step for integrating the discharge side end into a semi-sphere by intermittently heat fusing the discharge side end on which the covering member is applied.

2. The method of claim 1 wherein in the fusing step, fusing of the discharge side end of the electrode by at least one arc discharge is performed intermittently a plurality of times.

3. The method of claim 2 wherein in the fusing step a cooling period is provided between each of the plurality of times of fusing.

4. The method of claim 3 wherein a total time of the cooling periods is longer than a total time of the at least one arc discharge.

5. The method of claim 2 wherein of the plurality of times of fusing, a number of arc discharges in a first fusing is greatest, and a number of arc discharges in each successive fusing is no more than a number of arc discharges in an immediately preceding fusing.

6. The method of claim 1 wherein in the fusing step the discharge side end of the electrode is fused by performing laser irradiation intermittently a predetermined number of times.

7. The method of claim 6 wherein each of the predetermined number of laser irradiations is performed with a uniform interval therebetween.

8. The method of claim 7 wherein a repeat frequency which regulates the time intervals is in a range of 1 Hz to 20 Hz inclusive.

9. The method of claim 7 wherein a last laser irradiation of the predetermined number of laser irradiations has a lower output than preceding laser irradiations.

10. The method of claim 7 wherein a laser output becomes gradually lower in a last plurality of times of the predetermined number of times of the laser irradiations.

11. The method of claim 6 wherein an Nd-YAG laser is used for the laser irradiation.

12. The method of claim 1 wherein the covering member has a coil form.

13. The method of claim 1 wherein the electrode rod and the covering member have tungsten as a main constituent.

14. A method of manufacturing an electrode for a high pressure discharge lamp, the method comprising:

a covering member applying step for applying a covering member made of refractory metal on a discharge side end of an electrode rod made of refractory metal so as to cover a circumference of the electrode rod in a vicinity of the discharge side end, and a fusing step for integrating the discharge side end into a semi-sphere by intermittently heat fusing the discharge side end on which the covering member is applied.

15. The method of claim 14 wherein in the fusing step, fusing of the discharge side end of the electrode by at least one arc discharge is performed intermittently a plurality of times.

16. The method of claim 14 wherein in the fusing step the discharge side end of the electrode is fused by performing laser irradiation intermittently a predetermined number of times.

* * * * *